United States Patent [19]

D'Onofrio et al.

[11] Patent Number: 4,534,743

[45] Date of Patent: Aug. 13, 1985

[54] PROCESS FOR MAKING AN ELECTROLUMINESCENT LAMP

[75] Inventors: Anthony D'Onofrio, West Hartford; Walter Kitik, Wolcott, both of Conn.

[73] Assignee: Timex Corporation, Waterbury, Conn.

[21] Appl. No.: 528,310

[22] Filed: Aug. 31, 1983

[51] Int. Cl.[3] ..... H01J 9/02

[52] U.S. Cl. ..... 445/24; 445/49; 427/66; 219/68

[58] Field of Search ..... 445/24, 25, 49, 50; 427/66; 313/494; 219/68

[56] References Cited

U.S. PATENT DOCUMENTS

| | | | |
|---|---|---|---|
| 2,928,974 | 3/1960 | Mash | 315/169.3 X |
| 3,519,871 | 7/1970 | Kanie | 313/494 |
| 3,895,208 | 7/1975 | Kraus | 219/68 |
| 4,425,496 | 1/1984 | Fur et al. | 219/68 X |
| 4,455,324 | 6/1984 | Kamijo et al. | 427/66 |

*Primary Examiner*—Kenneth J. Ramsey

*Attorney, Agent, or Firm*—William C. Crutcher

[57] ABSTRACT

A process for making thin flexible electroluminescent lamps comprises continuously feeding a flexible strip of transparent insulating material which serves as the carrier for performing various process steps, as well as becoming part of the finished lamp itself. The strip is provided with a thin transparent conductive layer. An epoxy/phosphor mixture is continuously applied to a controlled thickness over the conductive layer and cured in an oven. Another conductive layer is continuously applied over the cured epoxy/phosphor layer on the carrier sheet and dried. In a preferred embodiment, lamp members are severed from the roll, and a narrow groove is made in the last applied conductive layer to divide the conductive layer into two exposed electrode areas to which the lamp terminals are connected. In another embodiment, the conductive layer on the plastic carrier sheet is continuously subdivided by vaporizing the conductive material to form a narrow groove with an electric arc. In this latter case, the conductive layers on the edges of the plastic carrier sheet serve as the two exposed electrode areas and receive terminals connected at the edges.

4 Claims, 12 Drawing Figures

PROCESS FOR MAKING AN ELECTROLUMINESCENT LAMP

This invention relates to the process for manufacturing thin flexible electroluminescent lamps in a continuous operation. More particularly, it relates to continuous manufacture of flexible electroluminescent lamps of a type in which exposed conductive areas for two or more electrodes are formed from the same layer of conductive material as part of the operation.

Electroluminescent displays were allegedly first discovered by Destriau in Paris in 1936. However, the first practical applications commenced around 1949. An early type of flexible electroluminescent lamp comprised a laminated structure enclosed in outer thermoplastic sheets forming an envelope and laminated with a vacuum plate. The active components of the electroluminescent lamp comprised an aluminum foil, a layer of insulation with a high dielectric constant overcoated with a layer of electroluminescent phosphor and finally overlayed with a sheet of conducting glass paper. Inasmuch as the laminate was enclosed in an envelope, two leads to activate the lamp were pressed against the aluminum foil and the conductive glass paper respectively and were embedded as part of the laminated structure. The leads extended out through the thermoplastic envelope. Such a construction is described in U.S. Pat. No. 3,047,052-Friedrich.

Simpler constructions for flexible electroluminescent panels were later developed in which a transparent plastic electrode formed one side of the lamp while the other electrode was a flexible metal foil such as aluminum, with a phosphor sandwiched between the electrodes, and the entire assembly incapsulated with a transparent plastic sheet of polyethylene terephthallate ("Mylar"). Such a construction is disclosed in British Pat. No. 1 073 879.

U.S. Pat. No. 3,252,845 discloses a flexible electroluminescent lamp, in which, rather than depositing the phosphor on an imperforate sheet of foil, employs a temporary support member and deposits the electroluminescent phosphor, dispersed in an organic polymeric matrix on a transparent conductive glass paper. Next, a thin insulating layer having a high dielectric constant, likewise dispersed in an organic polymeric matrix, is applied; and lastly, a back electrode of electrically conductive paint or paste or similar material is brushed, rolled, sprayed, or silk screened onto the insulating layer. The terminals are attached and the entire member enclosed between thermoplastic material and laminated in a hydrostatic press.

Another approach to providing continuous manufacture of flexible electroluminescent lamps is shown in U.S. Pat. No. 4,066,925-Dickson. Two preform webs are pressed together to provide large area electroluminescent devices. The preforms are manufactured ahead of time and stored in rolls. One preform comprises a conductive metal foil with a dispersion of electroluminescent particles in a polymeric binder. The other preform is a transparent substrate with a three-layer transparent electrode deposited thereon.

Most electroluminescent lamps have the electric driving signals applied to transversely spaced parallel conductive plates on opposite sides of the phosphor. However, a "split electrode" construction for an electroluminescent lamp is disclosed in U.S. Pat. No. 2,928,974 issued Mar. 15, 1960 to D. H. Mash. The split electrode construction attaches the source of electric driving voltage to laterally spaced electrodes, i.e. electrodes from the same conductive layer separated by a narrow insulating gap while the other transversely spaced conductive layer serves as a "floating" member and capacitively couples the two driving electrodes. The conductive layer containing the driving electrodes can be provided either from an embedded conductive transparent layer (Dickson) or from the conductive back layer (Mash), which may or may not be opaque. The present invention provides a process for conveniently manufacturing a flexible electroluminescent lamp employing the advantages of the split electrode construction.

In the Mash patent, the back electrode of lead dioxide was divided by scratching or cutting through the coating along a rectangular zig-zag line.

One problem in the prior art has been the lack of an economical process for continuously manufacturing flexible electroluminescent lamps with a simple type of construction and minimum number of steps. Previous methods have required laminated constructions of prepared elements and awkward methods of attaching the contact terminals to the lamp.

Accordingly, one object of the present invention is to provide a process for continuously manufacturing flexible electroluminescent lamps by applying the materials throughout the course of the process on a carrier strip, which itself becomes part of the lamp.

Another object of the invention is to provide a process for manufacturing a flexible electroluminescent lamp with a split electrode construction for ease of attachment of the connectors to the lamp.

Still another object of the invention is to provide an improved process for manufacturing flexible electroluminescent lamps for large area displays in a continuous production process.

DRAWINGS

These and many other objects of the invention will best be understood by references to the following description, taken in connection with the accompanying drawing in which:

FIG. 1 is a perspective view in schematic form illustrating the first steps of the process, FIG. 2 is a perspective view in schematic form illustrating the process of splitting the back electrode, FIG. 2*a* is a schematic view of the process of FIG. 2 extending the continuous process of FIG. 1.

FIGS. 3 and 4 are the front side and rear side plan views of an electroluminescent lamp made by the process, FIG. 5 is a cross-section taken along lines V—V of FIG. 4, FIG. 6 is a flow chart of the preferred process, FIG. 7 is a perspective view of a modified form of the process, FIGS. 8 and 9 are plan and side elevation views of a lamp made in accordance with the modified process, FIG. 10 is a cross-sectional view taken along lines X—X of FIG. 8, and FIG. 11 is a flow chart of the modified form of the process.

SUMMARY OF THE INVENTION

Briefly stated, the invention comprises the process of making a flexible split-electrode electroluminescent lamp comprising the steps of providing a transparent flexible carrier strip of insulating plastic material with a first continuous transparent coating of conductive material on it, continuously moving the carrier strip while depositing a slurry of a mixture of uncured epoxy resin and electroluminescent phosphor, passing the carrier strip through a curing oven and curing the resin to bond the phosphor material in a flexible matrix and to cause it to adhere to the first coating, depositing a slurry of liquid-borne conductive particulate matter continuously on the carrier strip, drying the slurry to provide a second continuous coating of electrically conductive material, removing conductive material to define a narrow groove in one of the conductive coatings, thereby providing at least two contiguous laterally spaced electrodes formed from the same conductive layer, and cutting the carrier strip into a desired lamp size. Preferably, the narrow groove is formed in the second conductive coating, but in a modified form of the invention, it can be removed from the first conductive coating.

DESCRIPTION OF THE PREFERRED EMBODIMENT

Figure 1:
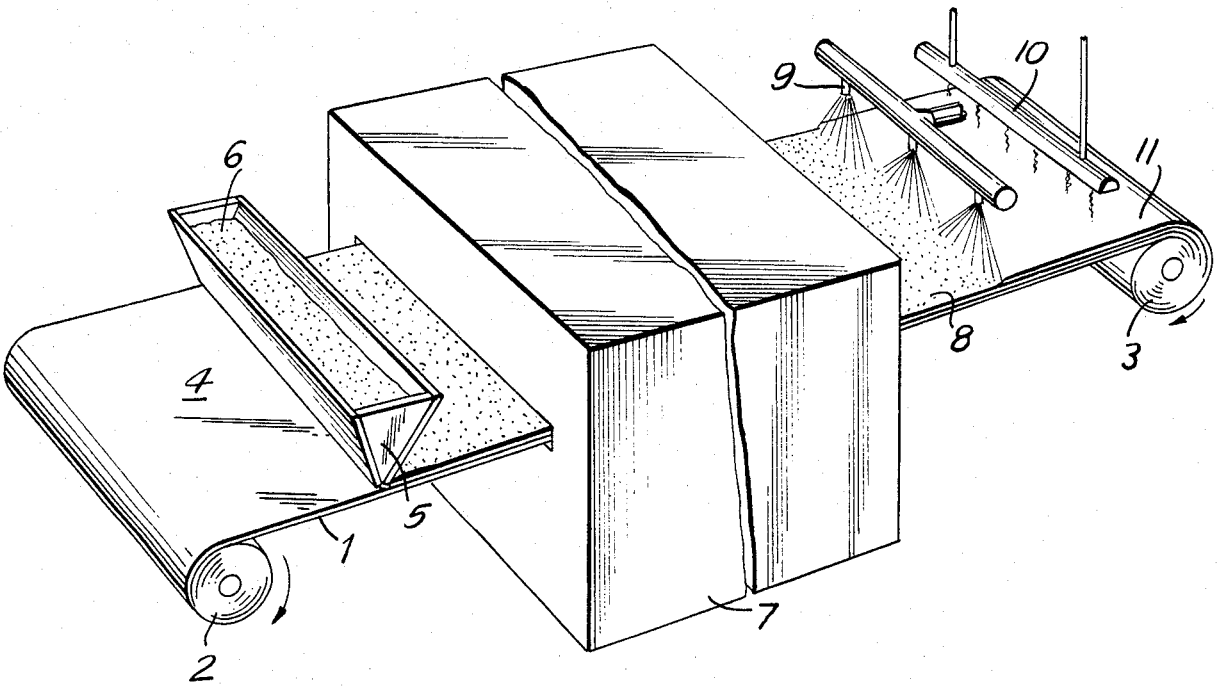

The preferred form of process is shown in FIGS. 1–5. In FIG. 1, there is provided a continuous carrier strip 1 of transparent insulating material which is conveniently stored on a roll 2. Means are provided to uncoil the carrier strip and drive it through a series of take-up rolls and guiding devices (not shown) and ultimately to coil the strip on another roll 3 at the other end of the line. A conventional motor drive (not shown) continuously moves the carrier strip 1 at a substantially continuous speed which may be selected in the range of 10–20 feet per minute. The carrier strip of transparent insulating material is preferably Mylar, a registered trademark of E. I. duPont de Nemours and Co., preferably having a thickness of about 5 mils.

A first continuous thin transparent coating 4 of electrically conductive material is provided on the carrier strip. The conductive coating may be indium tin oxide having a thickness of approximately 1000 Angstroms. Mylar with such a transparent conductive coating is commercially available as a material called Intrex, a registered trademark of the Sierracin Corporation.

A gravity feed trough 5 serves to deposit a slurry of a mixture of uncured epoxy resin and electroluminescent phosphor particles indicated by reference number 6 on top of the conductive coating 4 to a controlled thickness on the order of 1 to 5 mils, preferably 3.5 mills. Various types and particle sizes of phosphors and various types of uncured epoxy resins may be employed. A preferred mixture is a GTE Sylvania No. 727 phosphor intermixed with a two-part epoxy which serves as a dielectric binder in the proportion of 4:1 for phosphor and binder respectively. One epoxy resin binder which may be used is LOCTITE 75, commercially available from Loctite Corporation. A typical controlled layer thickness may be on the order of 3.5 mils. Other types of curable resin binder materials may be used which are well-known.

The epoxy binder is cured while travelling through a curing oven 7 at a temperature of approximately 140° C. This cures the epoxy and binds the electroluminescent phosphor material throughout the resin in a dielectric matrix and causes it to adhere to the conductive layer 4. The cured electroluminescent matrix layer, shown at 8 as it leaves the curing oven, is still relatively flexible. Other known means of curing the resin binder, such as ultraviolet radiation, may be used.

Next, a slurry of liquid-borne conductive particulate matter is deposited continuously on the carrier strip. The slurry may be sprayed from spray nozzles 9, and is preferably a water-borne, air-drying, nickel-filled, acrylic coating which is commercially available as EMILUX, a trademark of General Electric Company. The liquid carrier is driven off by means such as infrared heating lamps 10 to leave a dried second continuous coating of electrically conductive material, shown at 11, on top of the coating 8, having a thickness of approximately 2 mils.

Figure 2:
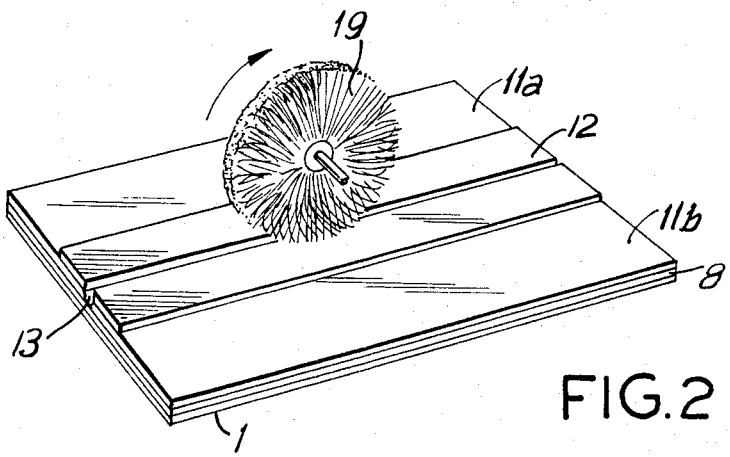
Figure 2A:
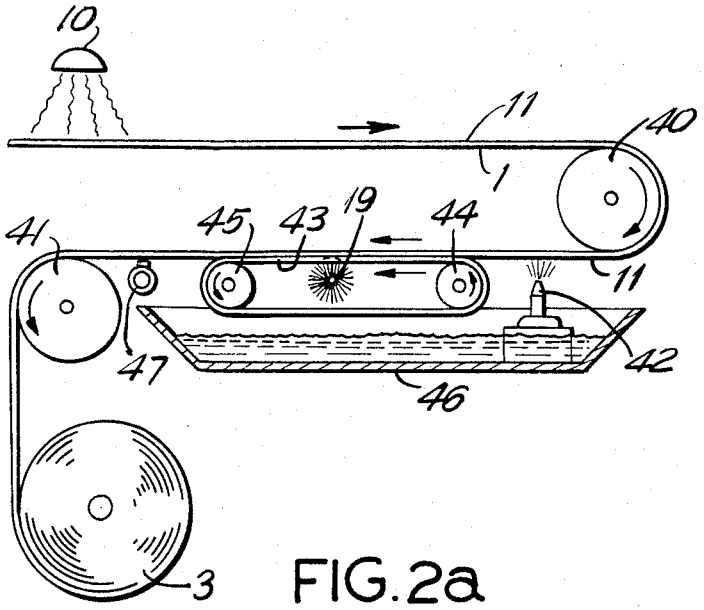

The conductive material is removed from the conductive layer 11, as illustrated in FIG. 2. This step may be carried out while the strip is continuously moving in a subsequent stage (not shown), as in FIG. 1, or it may be performed while, or after, the strip has been severed to a selected lamp size, as shown in FIG. 2. Conductive material is removed from the conductive layer 11 to define a narrow groove 13 in the conductive coating, thereby providing at least two laterally spaced contiguous electrodes, 11*a* and 11*b*, as shown in FIG. 2. One removal technique is to apply a solvent to the second conductive coating 11, protect the coating by means of a shield 12, and then to brush away the conductive material with brush 19. The removal of conductive coating 11 to provide a narrow groove is only shown in very simplified form in FIG. 2. The preferred process extends the length of the carrier strip in FIG. 1 beyond the drying lamps, as illustrated in FIG. 2*a*, by means of idler rollers 40, 41. The rollers extend the path of the carrier strip and invert it so that the conductive layer 11 is on the bottom of the laminated strip. A liquid solvent such as Blankothane is sprayed from a jet 42 on the conductive layer 11 in the area to be removed. The shields on either side of the area to be removed are shown as a pair of continuous belts 43 mounted on tapered rollers 44, 45 so that the belts 43 are spread apart and move at the same speed as the carrier strip. The brush 19 removes the conductive coating in the space between belts 43. The solvent and waste material is collected in a pan 46 beneath the belt and filtered for recirculation. Air jets 47 dry the coating and evaporate the solvent on the carrier strip, the strip is rolled up at 3 and stored for the subsequent severing and assembly operations. Another technique (not shown) is to employ a precision saw blade removing the conductive layer 11 down to the dielectric matrix 8. This may be done either as part of a continuous slitting and cut off operation, or in a subsequent operation as depicted to provide a groove 13 separating the electrodes 11*a* and 11*b*.

Figure 3:
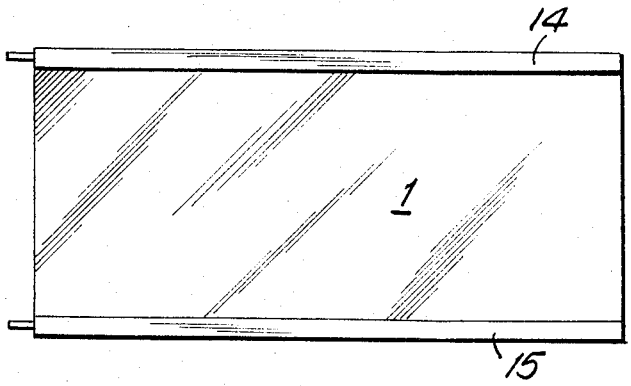
Figure 4:
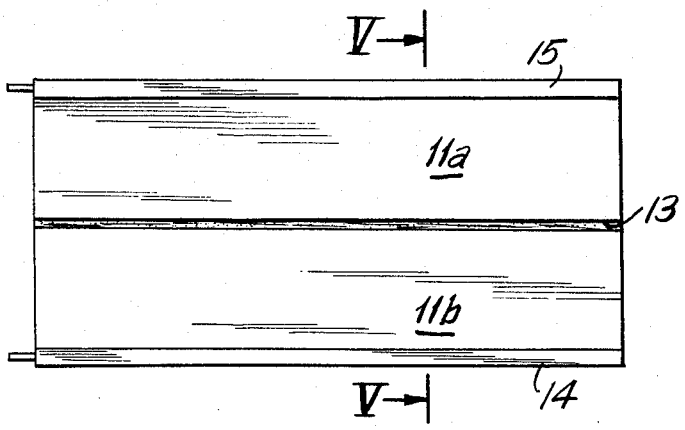
Figure 5:
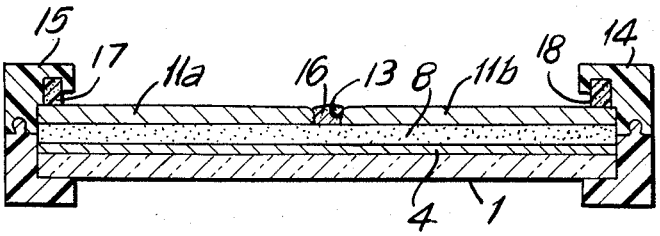
Figure 6:
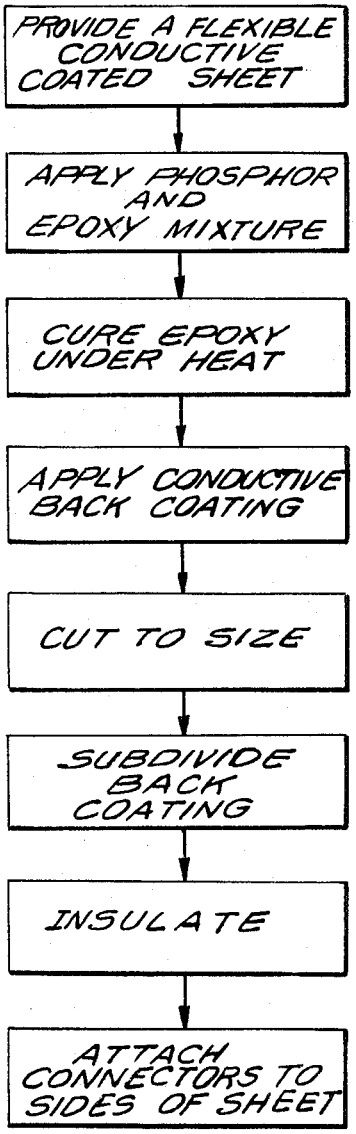
Figure 7:
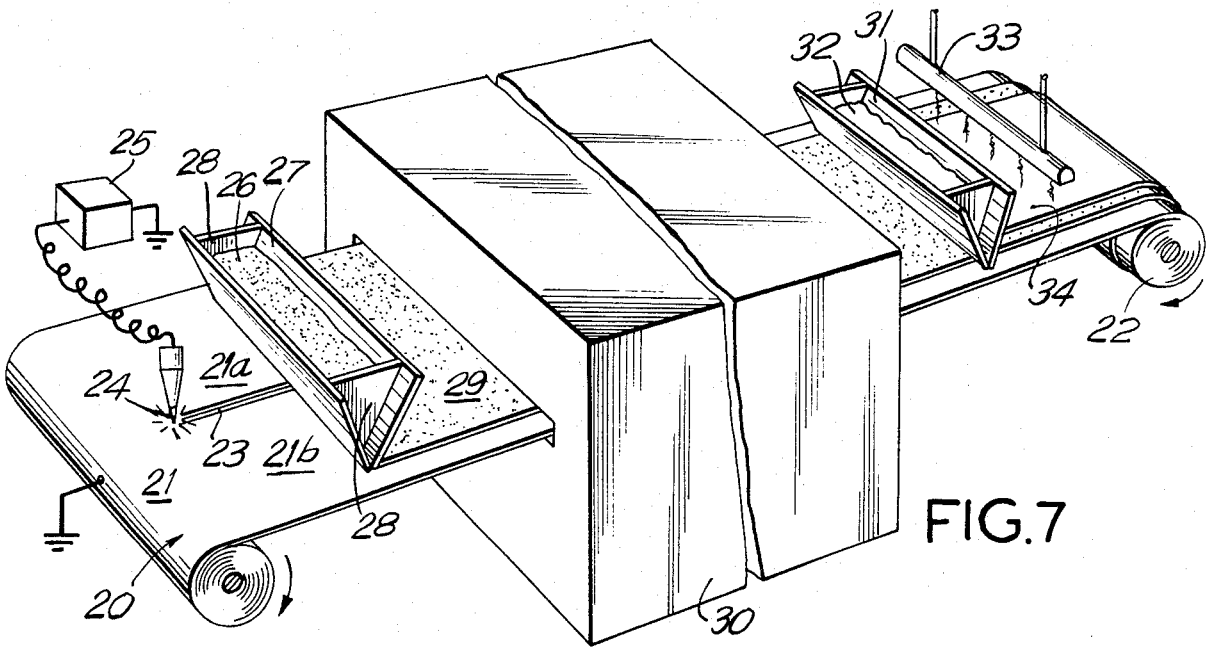

Completion of the lamp is illustrated in FIGS. 3–5. Insulating plastic connector holders 14, 15 are attached to opposite sides of the coated sheet. FIG. 3 shows the front side of the lamp and FIG. 4 the rear side. The groove 13 is then preferably filled with a high dielectric strength insulating material 16. The two exposed areas on 11*a* and 11*b* are contacted by electrically conductive pads 17, 18 which may be either conductive rubber or mechanical spring pads. Depending upon the application, many types of connectors may be employed and adapted to contact the exposed areas of the lamp electrodes. A flow chart of the process steps is shown in FIG. 6.

FIGS. 7–11 illustrate a modified form of the process. In this case, the carrier strip 20 of transparent insulating material, coated with transparent conductive coating 21, is fed through a series of steps and wound onto a take-up roll 22 in the same manner as before. However, in this case, the conductive material is removed from the initial conductive coating 21 to provide two contiguous laterally spaced electrode sections 21*a*, 21*b* with a narrow groove 23 between them. The conductive indium oxide may be continuously removed by an electric arc established between an electrode 24 and the grounded conductive coating. A power supply 25 supplies a potential of 60 volts DC, which effectively removes the conductive coating, leaving a gap of approximately 0.127 millimeters.

The epoxy/phosphor mixture 26 is applied from gravity feed trough 27. Moveable end walls 28 allow the width of the layer 29 to be adjusted, so as to leave the conductive layer 21 exposed on opposite sides of the carrier strip, for reasons to be explained.

The epoxy binder is cured as before while travelling through curing oven 30. A second feed trough 31 feeds the liquid borne slurry of conductive material 32, such as Emilux, and the infrared lamp 33 drives off the liquid leaving a layer 34 approximately 2 mils thick, which is substantially opaque.

Figure 8:
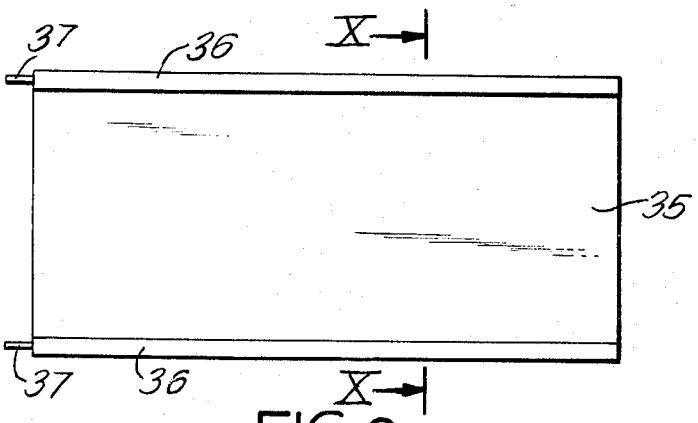

Referring to FIG. 8 of the drawing, the flexible sheet material is cut into desired lengths 35 and flexible connector holders 36 are attached to opposite sides of the sheet. Terminals 37 provide for making external connections to the power supply.

Figure 9:
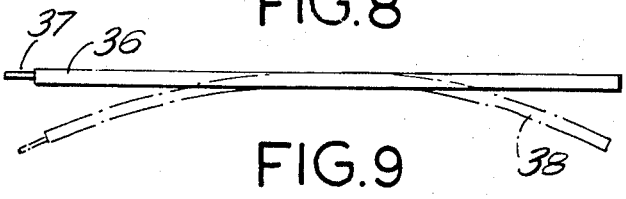
Figure 10:
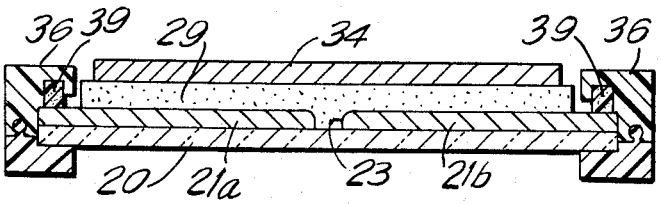
Figure 11:
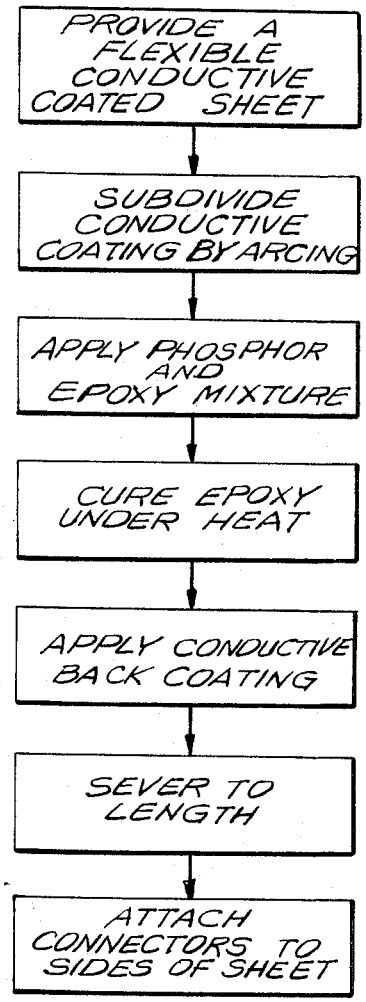

As shown in FIG. 9, the connector holders 36 may also be flexible, as indicated at 38, so that the lamp may be fitted to a contour. FIG. 10 shows that the connectors 36 may be arranged to clamp together over the opposite side edges of the sheet. A conductive pad 39 makes electrical contact with the exposed areas of conductive electrodes 21*a*, 21*b* at the edges of the strip. The pad 39 may be a mechanical spring member of conductive metal also.

In either case, whether the contiguous electrodes are formed from the first conductive layer or from the second conductive layer, attachment of a source of drive voltage to the electrodes will cause the opposite laterally electrode to capacitively couple the AC driving voltage through the dielectric matrix by way of the opposite "floating electrode" and cause the phosphor to luminesce. This will be visible through the transparent carrier strip member, which becomes a part of the lamp upon completion of the process. The overall lamp will be approximately 10 mils in thickness having great flexibility and in no case thicker than approximately 15 mils.

While there has been described in the foregoing specification, the preferred form of the process and one modification, it is desired to cover in the appended claims all such modifications as fall within the true spirit and scope of the invention.

We claim:

1. The process of making a flexible split-electrode electroluminescent lamp, comprising the steps of:

providing a transparent flexible carrier strip of insulating plastic material, providing a first continuous thin transparent coating of electrically conductive material on said carrier strip, moving said carrier strip at a substantially continuous rate of speed, depositing a slurry of a mixture of uncured resin binder and electroluminescent phosphor material continuously on said coated carrier strip to a controlled depth, curing the resin to bind the phosphor material in a flexible matrix and adhering it to said first coating, depositing a slurry of liquid-borne conductive particulate matter continuously on said carrier strip as it moves, drying said slurry to provide a second continuous coating of electrically conductive material on top of said flexible matrix, removing conductive material to define a narrow groove in said second one of said conductive coatings, wherein said conductive material is removed from said second coating by applying a solvent and brushing the coating while protecting the unremoved coating with a shielding device thereby providing at least two laterally spaced contiguous electrodes formed from the same conductive layer, and cutting said carrier strip into a desired lamp size, having exposed conductive sections on said respective contiguous electrodes which are adapted for attachment of electric contact terminals.

2. The process in accordance with claim 1, wherein said conductive material is removed continuously along said groove as the strip moves.

3. The process in accordance with claim 1, wherein said carrier strip is Mylar having a thickness on the order of 5 mils, wherein the first coating is indium oxide on the order of 1000 Angstroms, wherein the resin phosphor mixture is an epoxy phosphor mixture deposited with a thickness on the order of 1 to 5 mils and wherein the second conductive coating is particulate conductive material deposited to a depth of approximately 2 mils, said flexible electroluminescent lamp being a single laminated sheet having a total thickness on the order of 10 mils, but no greater than 15 mils.

4. The process in accordance with claim 1, wherein said resin is heat curable epoxy resin and the carrier strip is passed through a curing oven.

* * * * *